United States Patent [19]

Walgrove, III

[11] Patent Number: 4,775,915

[45] Date of Patent: Oct. 4, 1988

[54] FOCUSSED CORONA CHARGER

[75] Inventor: George R. Walgrove, III, Rochester, N.Y.

[73] Assignee: Eastman Kodak Company, Rochester, N.Y.

[21] Appl. No.: 104,469

[22] Filed: Oct. 5, 1987

[51] Int. Cl.[4] ..... G03G 15/02; H01T 19/00

[52] U.S. Cl. ..... 361/225; 361/230; 361/235; 355/3 CH; 250/324

[58] Field of Search ..... 361/225, 229, 230, 235; 355/3 CH; 250/324–326

[56] References Cited

U.S. PATENT DOCUMENTS

| | | | |
|---|---|---|---|
| 2,701,764 | 2/1955 | Carlson | 355/3 CH |
| 3,390,266 | 6/1968 | Epping | 250/324 |
| 3,660,656 | 5/1972 | Frank et al. | 250/324 |
| 4,053,770 | 10/1977 | Tanaka et al. | 250/324 |
| 4,088,892 | 5/1978 | Plumadore | 250/325 |
| 4,564,282 | 1/1986 | Shenoy | 361/235 X |
| 4,574,326 | 3/1986 | Myochin et al. | 361/329 |
| 4,591,713 | 5/1986 | Gundlach | 250/326 |
| 4,656,356 | 4/1987 | Yoda et al. | 250/326 |

*Primary Examiner*—L. T. Hix
*Assistant Examiner*—D. Rutledge
*Attorney, Agent, or Firm*—Milton S. Sales

[57] ABSTRACT

A corona charger includes a conductive electrode and a corona wire between the electrode and a receiver. A non-conductive shell about the wire is open toward the receiver. A voltage is periodically applied to the wire, whereby a corona charge is produced in the shell and the shell charges with the wire such that the corona charge is directed toward the receiver. A voltage is applied to the electrode of same sign but lagging the voltage applied to the wire such that the corona charge is accelerated by the electrode to the receiver when the voltage on the electrode approximates the voltage on the wire.

4 Claims, 2 Drawing Sheets

FOCUSSED CORONA CHARGER

BACKGROUND OF THE INVENTION

1. Field of the Invention

This invention relates generally to corona charging, and more particularly to an improved corona charger which is more compact and has a nonconductive shell for focusing a substantially constant current in a small area. The charger is particularly suitable for transfer charger operation in copiers.

2. Description of the Prior Art

Referring to FIG. 1, conventional corona charger designs for electrophotographic applications generally utilize a thin wire 10 surrounded by a grounded metal shell 12. Corona wire 10 is typically driven at a D.C. potential of say −5.4 kV, which results in a characteristic plate current-to-potential curve shown in FIG. 2.

Although the charger design of FIG. 1 is adequate for transfer purposes, its performance is not optimum. Consistent transfer performance requires that the electrostatic field generated in the transfer region be consistent. The transfer field is a function of the amount of charge deposited. The charger must lay down a constant level of charge irrespective of the receiver characteristics.

In conventional chargers with grounded shells, the current flow is divided between the grounded shell and the receiver surface, and the distribution is dependent upon the potential of the receiver surface. Tyically then, a more insulative receiver would charge to a higher surface potential than a more conductive receiver because the conductive receiver lets the charge migrate from its surface.

Conventional transfer chargers do not act as constant current devices. If the charger has a constant current power supply to the corona wire 10, the current is divided between the shell 12 and the receiver. As the potential of the receiver surface increases, the ratio of current to the shell and receiver changes. A charger set up to deliver the correct amount of charge for a receiver of one conductivity would not deliver the correct amount of charge if the receiver's conductivity changed because the charger is voltage sensitive.

For example, a dry paper receiver will be charged to a voltage of several hundred volts to deliver the desired transfer field (typically around 33 to 35 volts per micron). Under conditions of high humidity, paper is more conductive, and charge is conducted away from the receiver's surface. This lowers the potential of the surface, and the transfer charger responds to the lower surface potential of the receiver by tending to overcharge the receiver. An overcharged receiver creates image degradation due to breakdown, as well as complicating detack due to the excessive charge levels.

Another problem with conventional chargers is that, under dry conditions, they are not able to charge high enough due to the cutoff potential of the charger. As the receiver potential approaches this cut-off potential, corona output is suppressed and current output to the receiver goes to zero. This could be overcome just by increasing the wire potential, but current output will get excessively high, and high potentials result in overcharging in more humid conditions.

The problems mentioned above can be minimized by designing the charger to operate in a mode that better aproximates constant current operation and by reducing the transfer time. It is known that transfer to transparency material can be improved by increasing the charger cut-off potential. Unfortunately in conventional designs, this involves higher wire currents which generates excessive amounts of ozone. Wire to receiver arcing also becomes a danger due to the higher wire potentials involved. Since the speed of the receiver as it passes under the charger is fixed, typically due to other machine constraints, transfer time can only be reduced by decreasing the charger width. However, reduction of the charger width is not a possibility in conventional charger designs. Because of the high potential placed on the wire, a minimum distance d between the wire and conductive surfaces must be maintained to prevent wire to shell arcing. Accordingly, the charger must have a cross sectional dimension in the direction of travel of the receiver of at least twice the minimum distance d between the wire and conductive surfaces.

SUMMARY OF THE INVENTION

In accordance with the present invention a focussed corona charger has a periodically energized corona wire for creating a corona charge. A non-conductive shell about the wire is open towards a receiver surface, and a conductive electrode is situated on the side of the wire opposed to the receiver. A voltage is applied to the wire and, with a time lag to the electrode, whereby the wire voltage creates a corona charge. The non-conductive shell charges with the wire to a level whereby the corona charge is directed toward the receiver. Since the electrode voltage lags the wire voltage, a useful amount of charge is generated before being accelerated by the electrode to the receiver when the voltage on the electrode approximates the voltage on the wire.

The focussed charger of this invention provides better transfer performance. The design is physically half the width of conventional charger, which is made possible by using a non-conductive shell material to inhibit wire to shell arcing. This not only eliminates the air breakdown problem, but also allows for lower fabrication costs.

The electrode increases the percentage of wire current which reaches the receiver, thereby increasing the charger efficiency. This permits operation at lower current levels because current is not being lost to the shell. Because the spreading of the charge is limited, the receiver is charged over a smaller region, to inhibit wire to shell arcing minimizing the transfer time. The focussed charger is runable at higher wire potentials to increase the charger cut-off without overcharging during humid conditions because the current is quenched after a fixed amount of charge has been delivered to the receiver. The result is a transfer charger that is smaller, more efficient, generates less ozone, and provides better transfer latitude.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

Figure 1:
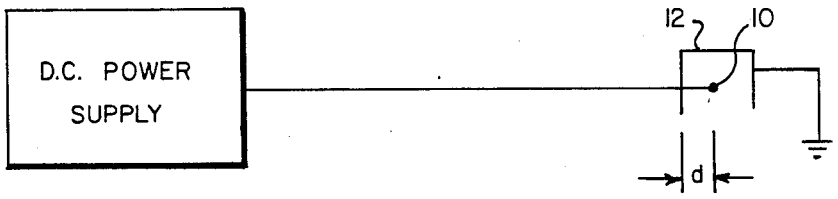
PRIOR ART FIG. 1
FIG. 1 is a schematic view of a corona charger system known in the prior art.
Figure 3:
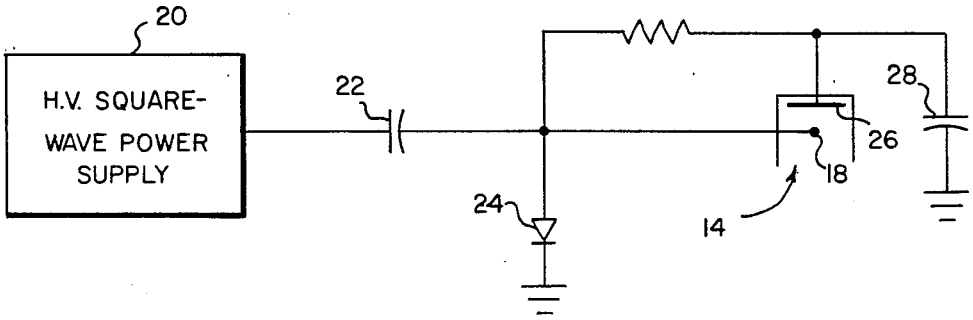
FIG. 3 is a schematic view of a focussed charger and power supply configuration in accordance with a preferred embodiment of the present invention.

A focussed charger 14 is illustrated in FIG. 3. The charger is approximately one-half the width of the conventional charger shown in FIG. 1. The charger shell is constructed of non-conductor, such as plexiglass, and a corona wire 18 is positioned within the shell. A 3 mil diameter wire conventionally used in existing charger designs is satisfactory.

A power supply 20 delivers a constant voltage AC square wave signal. A capacitor 22 and a diode 24 form a doubling circuit which rectifies the waveform for negative output and provides the high wire potential required to increase the charger cut-off value. It should be understood that the doubling circuit is used strictly to generate a high potential on the wire. This requirement can also be satisfied by using a very high potential power supply or a pulsed supply. An electrode such as a plate 26 is biased through a high impedance resistor, also from power supply 20. The RC circuit which includes capacitor 22 creates a time delay so that wire 18 charges to its peak voltage before electrode plate 26. Optionally, a second capacitor 28 may be used to increase the system's time constant.

Upon initiation of the negative half cycle of power supply 20, wire 18 is biased to a high negative potential, and a cloud of corona charge is generated around the wire. Electrode plate 26, which is biased at the same polarity, lags the wire potential due to the time constant of the RC circuit. This allows the wire to generate a useful amount of corona charge before the plate reaches the wire potential, quenching the corona generation. The quenching effect limits the amount of charge to that needed, for example for transfer. The negative charge on the shell and on plate 26 force the corona charge within the shell down to the receiver surface. The side walls of the shell, because of their low capacitance, also charge up very quickly, and contribute to this focussing effect. As a result, the charger delivers nearly 100% of the generated charge to the receiver surface. Moreover, because of the physically small size and the focussing effect, the charge is delivered to only a small region of the receiver where transfer is accomplished. A very short transfer time is obtained, and the charge on the receiver surface does not have much time to travel through the receiver, even in humid conditions. Therefore, charging is completed while the charge is still near the receiver surface, the charger sees substantially the same surface potential regardless of humidity, and the same amount of charge is delivered regardless of conductivity of the receiver.

Figure 2:
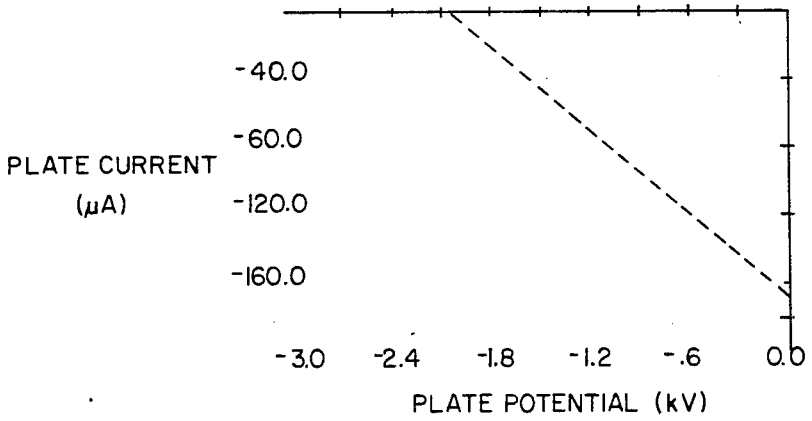
FIG. 2 is a plot of plate current to voltage of the system of FIG. 1.
Figure 4:
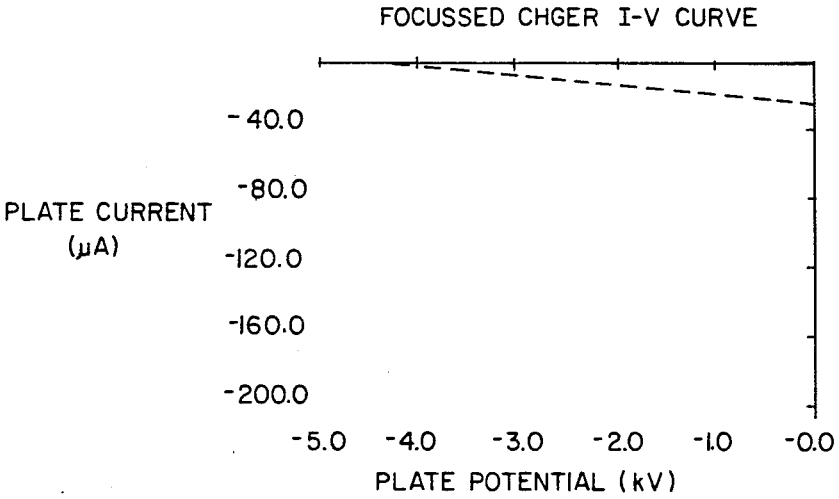
FIG. 4 is a plot of plate current to voltage of the system of the focussed charger and power supply configuration of FIG. 3.

A plot of representative plate current and voltage for this charger is shown in FIG. 4. For this curve and that of FIG. 2 for a conventional DC transfer charger, only the short circuit current and the cutoff potential were measured, which defines the end points of the curves but not the curve shapes. When the two figures are compared, significant difference between the two chargers can be seen. The focussed charger behaves much more like a constant current charging device.

The invention has been described in detail with particular reference to preferred embodiments thereof, but it will be understood that variations and modifications can be effected within the spirit and scope of the invention. For example this invention includes any corona device that uses the shell or a bias plate to focus the charge released onto the charging surface.

Although discussed for transfer application, this technique can also be used for other electrostatographic applications simply by redesigning the condition circuitry. For example, for detack charging an ac output is required. By elimination of diode 24 (FIG. 3), both positive and negative charges would be delivered. In a primary charger, one could simply provide a grid in front of the charger to control the output.

What is claimed is:

1. A corona charger for charging a receiver, said charger comprising:

a conductive electrode;

a corona wire between said electrode and the receiver;

a non-conductive shell about said wire, said shell being open toward the receiver;

means for periodically applying a voltage to said wire, whereby a corona charge is produced in said shell and said shell charges with said wire such that the corona charge is directed toward the receiver; and means for applying a voltage to said electrode of same sign and substantially the same potential as the wire, but lagging the voltage applied to said wire such that the corona charge is accelerated by the electrode to the receiver when the voltage on the electrode approximates the voltage on the wire.

2. A corona charger as set forth in claim 1 wherein said electrode is within said shell.

3. A corona charger as set forth in claim 1 wherein said means for periodically applying a voltage to said wire is a rectified ac voltage source.

4. A corona charger as set forth in claim 1 wherein said means for applying a voltage to said electrode includes an RC circuit for creating a time lag between the wire and electrode voltages

* * * * *